United States Patent [19]

Steck et al.

[11] 4,238,921

[45] Dec. 16, 1980

[54] COOLING DEVICE AND METHOD FOR COOLING A HEATED TRAVELLING THREAD

[75] Inventors: Arnold Steck, Wattwil; Armin Wirz, Ossingen, both of Switzerland

[73] Assignee: Rieter Machine Works, Ltd., Winterthur, Switzerland

[21] Appl. No.: 31,305

[22] Filed: Apr. 18, 1979

[30] Foreign Application Priority Data

Apr. 19, 1978 [CH] Switzerland ..... 4183/78

[51] Int. Cl.[3] ..... D01H 7/46; D01H 13/26

[52] U.S. Cl. ..... 57/284; 62/63; 62/331; 62/374; 57/308

[58] Field of Search ..... 62/63, 64, 341, 374, 62/375, 376, 378, 331; 57/284, 308

[56] References Cited

U.S. PATENT DOCUMENTS

| | | | |
|---|---|---|---|
| 3,068,586 | 12/1962 | Vaughan et al. | 62/63 |
| 3,267,585 | 8/1966 | Futer | 62/380 |
| 3,327,461 | 6/1967 | Wyatt | 57/284 |
| 3,864,931 | 2/1975 | Guttinger | 62/63 |
| 4,040,269 | 8/1977 | Nordblad et al. | 62/374 |

FOREIGN PATENT DOCUMENTS 597391 4/1978 Switzerland .

*Primary Examiner*—Ronald C. Capossela
*Attorney, Agent, or Firm*—Kenyon & Kenyon

[57] ABSTRACT

Method and apparatus for cooling of a thread between a heating device and false twist spindle of a texturing machine. A part of the cooling medium (30) is guided in the direction of the thread transport and another part is guided against the direction of the thread transport through parts of a duct (11). The duct (11) is provided with rectangular chambers (14), arranged mutually offset, causing repeated flow of the cooling medium (30) across the thread (1) under vigorous vortex formation.

23 Claims, 4 Drawing Figures

COOLING DEVICE AND METHOD FOR COOLING A HEATED TRAVELLING THREAD

This invention relates to a cooling device and a method for cooling a heated travelling thread. More particularly, this invention relates to a cooling device and method for cooling a travelling thread passing between a heating device and a false twist spindle of a texturing machine.

As is known, in texturing threads or yarns of thermoplastic synthetic material, a high level of false twist is usually imparted to the thread. Generally, during a false twist process, a thread is brought into a highly twisted state, is then temporarily brought into a plastic state by heating and thereupon cooled to effect a resolidification and thus fixation of the deformation of the thread fibrils. Heretofore, in the known false twist devices for texturing, heating of the threads is effected, for example, during the passage of the thread over a heated surface of a heating device while cooling is effected during passage of the thread through an air zone at room temperature. However, it has been found that at higher thread throughput speed, this air zone would have to be made much too long if effective cooling is to be achieved. Further, at the high texturing speeds in practical use today, shortening of the cooling zone as much as possible is required. In many cases, use has been made of a specific cooling device downstream from the heating device for cooling of the thread.

One known cooling device for cooling a thread in a texturizing machine is described in Swiss Pat. No. 597,391. As described, the cooling device is constructed so as to define a thread path limiting device through which a cooling medium can flow. To this end, the cooling device consists of a strip which forms a helix of a predetermined helix-clearance and in which a nozzle is arranged at the upper end as viewed in the direction of thread transport of the thread path limiting device. The nozzle is arranged in such a manner that the cooling medium is injected against the inside wall of the thread path limiting device. However, this cooling device presents a number of disadvantages. For example, the thread is set into vibration. Further, in spite of the high consumption of cooling medium, the cooling effect on the thread is not satisfactory.

Accordingly, it is an object of the invention to provide a relatively simple technique for cooling a travelling heated thread.

It is another object of the invention to provide a cooling device of relatively simple construction for cooling a heated thread.

It is another object of the invention to obtain an optimum thread cooling effect at low consumption of cooling medium.

It is another object of the invention to obtain an optimum thread cooling effect while transporting a thread in a very smooth vibration-free manner.

Briefly, the invention provides a cooling device and method for cooling a heated travelling thread.

The cooling device is constructed to have a duct which extends on an axis between an entry opening and an outlet opening for the travelling thread. In additon, the duct has a plurality of chambers disposed in mutually offset relation along the axis as well as an opening communicating with the duct for introducing a cooling medium into the duct. The chambers are arranged symmetrically in mutually offset relation while the opening for the cooling medium is disposed centrally of the duct.

The cooling device is constructed of a base plate, a pair of slats of equal thickness which are disposed on the base plate in parallel spacing relation and a cover plate which is disposed over the slats to define the duct.

In order to define the chambers, each slat is provided with a plurality of rectangular recesses. These chambers are arranged so that the cooling medium which enters into the duct is repeatedly deflected in a zig-zag manner along the thread path under a vigorous vortex formation.

The cover plate is movably mounted so as to move between an operating position covering over the duct and a threading in position exposing the duct. When in the threading in position, a thread can be easily placed into the duct at the start of an operation.

The method of cooling a heated travelling thread is comprised of the steps of transporting the thread through a thread path in a closed duct and of guiding a cooling medium through the duct in a zig-zag path to immediately cross the thread path. In addition, the cooling medium is directed in one part flow in the direction of thread transport in the duct and in a second part flow in a direction opposite to the direction of said thread transport in the duct.

These and other objects and advantages of the invention will become more apparent from the following detailed description taken in conjunction with the accompanying drawings wherein.

Figure 1:
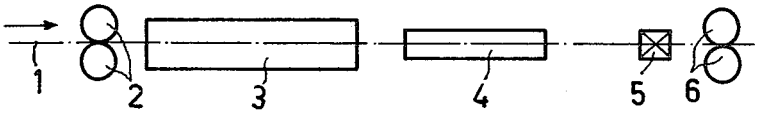
FIG. 1 illustrates a schematic view of various components of a texturizing machine employing a cooling device according to the invention.

Referring to FIG. 1, a texturing machine for a travelling thread 1 employs a pair of supply rolls 2, a heating device 3 to which the thread 1 is supplied by the rolls 2, a cooling device 4, a false twist spindle 5 and a pair of take-off rolls 6. During operation, the thread is heated within the heating device 3, cooled in the cooling device 4, passed through the false twist spindle 5 and is then transferred by the rolls 6 to a treating station (not shown) downstream of the rolls 6. A false twist is imparted to the thread 1 in the false twist spindle 5 and is propagated back to the pair of supply rolls 2. The thread 1 is brought into a plastic state on a heated surface of the heating device 3 whereupon the deformation of the individual fibrils of the thread effected by the false twist is fixed in the cooling device 4.

Figure 2:
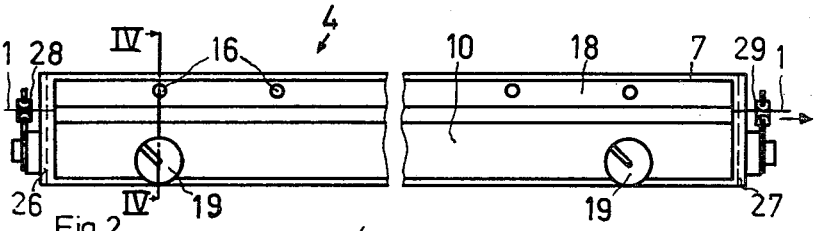
FIG. 2 illustrates a side view of a cooling device in accordance with the invention.
Figure 3:
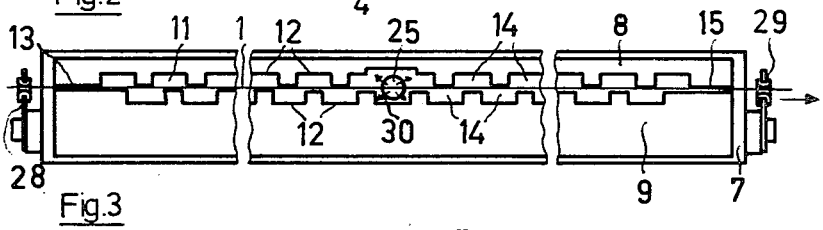
FIG. 3 illustrates a view similar to FIG. 2 with various parts of the cooling device removed.
Figure 4:
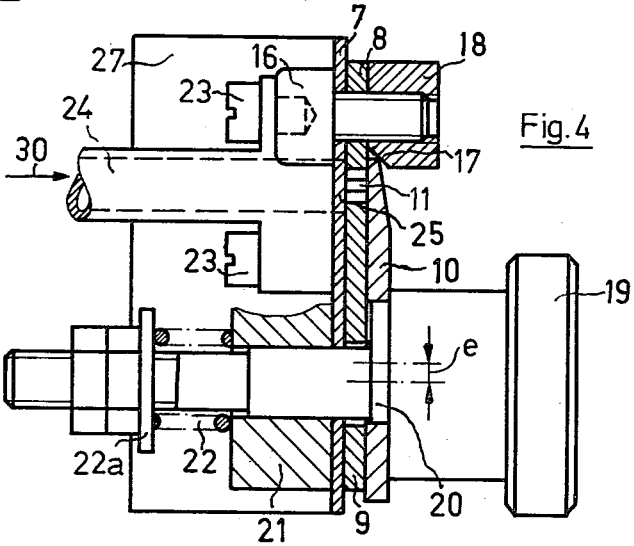
FIG. 4 illustrates a view taken on line IV—IV of FIG. 2.

Referring to FIGS. 2 to 4, the cooling device 4 is comprised of a thin base plate 7 onto which a pair of slats 8, 9 of equal thickness are adhesively mounted in parallel spaced facing relation to define a clearance therebetween. In addition, the cooling device 4 has a cover plate 10 disposed over the slats 8, 9 to define a closed duct 11. As shown in FIG. 3, the facing longitudinal sides of the slats 8, 9 are provided with rectangular recesses 12. In addition, the slats 8, 9 are arranged so that the duct 11 consists of a narrow entry opening 13 at one end of the slats 8, 9 and a narrow outlet opening 15 at the opposite end of the slats 8, 9. The recesses 12 form a plurality of mutually offset rectangular chambers 14 along the axis of the duct 11.

Referring to FIGS. 2 and 4, one slat 8 is mounted on the base plate 7 by imbus screws 16 in addition to being adhesively fixed to the base plate 7. The screws 16 are threaded into a further slat 18 which is provided with a bevelled inclined edge 17. The cover plate 10 is pressed against the inclined edge 17 and the slats 8, 9 by two excenter screws 19 which contain an eccentric portion 20 offset by an eccentricity e with respect to the axis of a screw 19. Each excenter screw 19 is guided in a holder 21 mounted on the opposite side of the base plate 7 and is pressed against the cover plate 10 by a coil spring 22 arranged between the holder 21 and a disc 22*a* held on the screw 19, for example by means of two lock nuts.

As shown in FIG. 4, a tube 24 is flanged to the base plate 7 by screws 23. In addition, the base plate 7 is provided with an opening 25 which is coextensive with the internal diameter of the tube 24 and communicates with the duct 11. The tube 24 is connected with a source of compressed air (not shown).

Referring to FIGS. 2 and 4, the base plate 7 is provided with face sides 26, 27 which are arranged at right angles to the base plate 7 and open thread guides 28, 29 are mounted on the respective base sides 26, 27. These guides 28, 29 each have a guide opening arranged on the axis of the duct 11 for guiding the thread 1 into and through the duct 11.

During operation of the cooling device 4, a cooling medium such as compressed air 30 is passed through the tube 24 via the opening 25 into the duct 11. One part flow of the air then flows in the direction of the thread transport in the duct 11 while the second part flow flows in a direction opposite to the direction of thread transport in the duct 11. These respective part flows pass out of the respective openings 13, 15 at the end of the duct 11. During passage through the mutually offset chambers 14, the cooling air 30 undergoes a vigorous vortex formation and is repeatedly deflected in a zig-zag manner across the thread path in such a manner that the cooling air 30 remains for a relatively long time in the duct 11 before escaping via the openings 13, 15.

The heated thread 1 coming in from the heating device 3 passes through the cooling device 4 via the thread guide 28, the entry opening 13, the duct 11, the outlet opening 15 and via the thread guide 29. During this passage, the thread is sufficiently cooled by the cooling air 30 which repeatedly crosses the thread path. The thread 1 which moves at high speeds, for example from 600 to 1200 meters per minute, through the cooling device 4 is precisely guided by the thread guide 28, 29 in such a manner as to pass through the duct 11 virtually contact free in the cooling air stream across the thread.

When starting up the cooling device 4, the excenter screws 19 are turned so that the cover plate 10 is moved away from the slat 18 into a threading-in position via the eccentric screw portions 20. In this position, the duct 11 is exposed and the thread 1, for example through use of a suction gun, is simply placed first into the opening of the thread guide 28, then the duct 11 and finally into the opening of the thread guide 29. By turning the eccentric screws 19 back, the cover plate 10 is moved back over the duct 11 into abutment with the inclined edge 17 of the slat 18, so as to take up an operative position. The supply of cooling air can then be started through the tube 24 and the cooling device 4 starts operating.

The moveability of the cover plate 10 permits uncovering of the duct 11 and thus permits a very simple threading of the thread 1 into the cooling device 4.

As the cooling air can pass through the duct 11 only under a vortex formation, the air remains in the duct 11 over a prolonged time delay and is warmed up considerably. This also indicates that the cooling air draws much heat from the thread 1 and that a low quantity of cooling air achieves considerable cooling effect. The air in the duct 11 transfers heat to the parts forming the duct 11 and these parts are thus heated. As the two slats 8, 9, the base 7 and the cover plate 10 are of small thickness, these components are heated within a short time after start-up of the device 4 in such a manner that a constant temperature of the cooling device 4 is achieved shortly after starting up of a texturing process. Thus, a constant cooling effect is established at a given texturing speed. If a change in texturing speed is required, the cooling effect can be adapted by changing the pressure of the supplied cooling air.

Experiments have shown that a very smooth and vibration free thread passage and an optimum cooling effect can be achieved by arranging the opening 25 for the cooling air at the center of the cooling duct 11.

In one particular embodiment, the cooling device 4 is constructed with a length of about 430 millimeters and a width of about 40 millimeters. The thickness of the base plate 7 is one millimeter, the thickness of each slat 8, 9 is two millimeters and the slats 8, 9 are disposed at a mutual distance of 1 millimeter such that the entry opening 13 in the outlet opening 15 of the duct 11 are of a cross-sectional area of two square millimeters. The slats 8, 9 are each provided with about 20 recesses in their middle part of a length of 12 millimeters and a depth of 4 millimeters. The non-recessed parts of the slats 8, 9 are of a length of six millimeters. In order to achieve optimum vortex formation, the recesses of both slats 8, 9 are symmetrically arranged in mutually offset manner.

The above cooling device was tested on a texturing machine in which a PE (polyester thread) of 167 dtex was textured at a speed of 800 millimeters per minute. A thread temperature of 190° Centigrade was measured upstream of the entry into the cooling device and a thread temperature of 80° Centigrade was measured at the outlet of the cooling device. The cooling air was supplied to the device at a pressure of 0.5 bar above atmosphere pressure and resulting compressed air consumption was measured at a very low rate of 2.5 $Nm^3/h$.

What is claimed is:

1. A cooling device for cooling a heated travelling thread, said device having a duct defining a thread path between a thread entry opening and a thread outlet opening and having a plurality of chambers disposed in mutually offset relation along said path, said chambers being arranged whereby a cooling medium entering said duct is repeatedly deflected in a zig-zag manner along said path under a vigorous vortex formation.

2. A cooling device as set forth in claim 1 wherein said chambers are arranged symmetrically in mutually offset relation.

3. A cooling device as set forth in claim 1 which further comprises an opening communicating with said duct centrally of said duct for introducing a cooling medium into said duct.

4. A cooling device as set forth in claim 1 which includes a base plate, a pair of slats of equal thickness disposed on said base plate in parallel spaced facing relation and a cover plate disposed over said slats to define said duct.

5. A cooling device as set forth in claim 4 wherein said slats define each of said entry opening and outlet opening therebetween.

6. A cooling device as set forth in claim 4 wherein said opening for cooling medium is in said base plate.

7. A cooling device as set forth in claim 4 wherein said slats are adhesively secured to said base plate.

8. A cooling device as claimed in claim 1 wherein said chambers are separated by projections in said duct, the lengths of the chambers along said thread path being greater than the corresponding lengths of the projections.

9. A cooling device as claimed in claim 8 wherein said chambers are substantially rectangular when viewed in section.

10. A cooling device as claimed in claim 1 wherein said thread path is substantially straight and defined between first and second thread guides near said thread entry opening and said thread outlet opening respectively.

11. A cooling device for cooling a heated travelling thread, said device comprising a base plate, a pair of slats of equal thickness disposed on said base plate in parallel spaced facing relation, each slat having a plurality of rectangular recesses facing the other slat;

a cover plate disposed over said slats to define a duct extending from an entry opening at one end of said slats to an outlet opening at an opposite end of said slats, and an opening in said base plate communicating with said duct for introducing a cooling medium into said duct.

12. A cooling device as set forth in claim 11 wherein each said recess defines a chamber, and said chambers are disposed in mutually offset relation along said duct.

13. A cooling device as set forth in claim 11 wherein said cover plate is movably mounted to move between an operating position covering over said duct and a threading-in position exposing said duct.

14. In combination with a texturing machine having a heating device for heating a travelling thread and a false twist spindle for imparting a false twist to the thread; a cooling device between said heating device and said false twist spindle for cooling the thread, said cooling device having a duct defining a thread path between a thread entry opening and a thread outlet opening and having a plurality of chambers disposed in mutually offset relation along said path, said chambers being arranged whereby a cooling medium entering said duct is repeatedly deflected in a zig-zag manner along said path under a vigorous vortex formation.

15. A method of cooling a heated travelling thread extending between a heating device and a false twist spindle of a texturing machine, said method comprising the steps of transporting the thread through a thread path in a closed duct; and guiding a cooling medium through the duct in a zig-zag manner along said thread path under a vigorous vortex formation.

16. A method as set forth in claim 15 wherein the cooling medium is directed in one part-flow in the direction of thread transport in the duct and in a second part-flow in a direction opposite to the direction of thread transport in the duct.

17. A method as set forth in claim 15 wherein the cooling medium is compressed air.

18. A cooling device for cooling a heated travelling thread, said device having a base plate;

a pair of slats of equal thickness disposed on said base plate in parallel spaced facing relation, each slat having a plurality of rectangular recesses therein forming a plurality of chambers disposed in mutually offset relation;

a cover plate disposed over said slats to define a duct extending on an axis between an entry opening and an outlet opening; and an opening communicating with said duct for introducing a cooling medium into said duct.

19. A cooling device for cooling a heated travelling thread, said device having a base plate, a pair of slats of equal thickness disposed on said base plate in parallel spaced facing relation and a cover plate disposed over said slats to define a duct extending on an axis between an entry opening and an outlet opening and having a plurality of chambers disposed in mutually offset relation along said axis and an opening communicating with said duct for introducing a cooling medium into said duct, said cover plate being movably mounted to move between an operating position covering over said duct and a threading-in position exposing said duct.

20. A cooling device as set forth in claim 19 which further comprises at least a pair of eccentric screws securing said cover plate to one of said slats in movable relation.

21. A cooling device as claimed in claim 19 wherein means is provided to urge the cover plate towards the slats when the plate is in its operative position.

22. A cooling device as claimed in claim 21 wherein said means comprises a wedging surface arranged to be engaged by the cover plate as the latter is moved into its operative position.

23. A method of cooling a heated travelling thread extending between a heating device and a false twist spindle of a texturing machine, said method comprising the steps of transporting the thread through a thread path in a closed duct; and guiding a cooling medium through the duct along a flow path to repeatedly cross said thread path, which flow path is of a zig zag configuration such that vigorous vortices are formed in the cooling medium during its passage along said flow path.

* * * * *